US009870734B2

(12) United States Patent
Yang

(10) Patent No.: US 9,870,734 B2
(45) Date of Patent: Jan. 16, 2018

(54) ORGANIC LIGHT EMITTING DISPLAY AND DRIVING METHOD THEREOF

(71) Applicant: Samsung Display Co., Ltd., Yongin, Gyeonggi-do (KR)

(72) Inventor: Jin-Wook Yang, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 127 days.

(21) Appl. No.: 14/539,948

(22) Filed: Nov. 12, 2014

(65) Prior Publication Data

US 2015/0130859 A1 May 14, 2015

(30) Foreign Application Priority Data

Nov. 13, 2013 (KR) ..... 10-2013-0137303

(51) Int. Cl.

| | |
|---|---|
| ***G09G 3/32*** | (2016.01) |
| ***G09G 3/3233*** | (2016.01) |
| *G09G 3/3208* | (2016.01) |
| *G09G 3/30* | (2006.01) |

(52) U.S. Cl.

CPC ..... *G09G 3/3233* (2013.01); *G09G 3/30* (2013.01); *G09G 3/3208* (2013.01); *G09G 2300/0819* (2013.01); *G09G 2300/0852* (2013.01); *G09G 2300/0861* (2013.01)

(58) Field of Classification Search

CPC ... G09G 3/3208; G09G 2320/045; G09G 3/30
USPC ..... 345/76, 82
See application file for complete search history.

(56) References Cited

U.S. PATENT DOCUMENTS

| | | | | |
|---|---|---|---|---|
| 2002/0063835 | A1* | 5/2002 | Kim | G02F 1/134363 349/141 |
| 2006/0267885 | A1* | 11/2006 | Kwak | G09G 3/3233 345/76 |
| 2011/0007067 | A1* | 1/2011 | Ryu | G09G 3/3233 345/214 |
| 2011/0227505 | A1 | 9/2011 | Park et al. | |
| 2012/0113077 | A1 | 5/2012 | Kang | |

(Continued)

FOREIGN PATENT DOCUMENTS

| | | | |
|---|---|---|---|
| KR | 10-2011-0104705 | A | 9/2011 |
| KR | 10-2012-0048294 | A | 5/2012 |
| KR | 10-2014-0146807 | | 12/2014 |

*Primary Examiner* — Yuzhen Shen
(74) *Attorney, Agent, or Firm* — Lewis Roca Rothgerber Christie LLP

(57) ABSTRACT

An organic light emitting display includes pixels, a scan driver configured to supply a scan signal to a specific scan line during a third period of the sensing frame, and configured to sequentially supply scan signals to the scan lines during a sixth period of the sensing frame, a data driver configured to supply, to the data lines, a previous data signal corresponding to a gray scale according to the scan signal supplied to the specific scan line during the third period, and configured to supply a current data signal to the data lines to be synchronized with the scan signals supplied during the sixth period, and a compensation unit configured to extract the threshold voltage and mobility information of the driving transistor from pixels at a specific horizontal line and coupled to the specific scan line before the scan signal is supplied during the third period.

15 Claims, 4 Drawing Sheets

(56) References Cited

U.S. PATENT DOCUMENTS

| | | | | |
|---|---|---|---|---|
| 2013/0077038 | A1* | 3/2013 | Rho | B82Y 20/00 349/144 |
| 2013/0083001 | A1* | 4/2013 | Jeong | G09G 3/3233 345/212 |
| 2013/0141316 | A1 | 6/2013 | Lee et al. | |
| 2014/0176401 | A1* | 6/2014 | Kim | G09G 3/3208 345/76 |
| 2014/0320473 | A1* | 10/2014 | Ma | G09G 3/3233 345/211 |
| 2014/0368489 | A1 | 12/2014 | Pak | |

* cited by examiner

ORGANIC LIGHT EMITTING DISPLAY AND DRIVING METHOD THEREOF

CROSS-REFERENCE TO RELATED APPLICATION

This application claims priority to and the benefit of Korean Patent Application No. 10-2013-0137303, filed on Nov. 13, 2013, in the Korean Intellectual Property Office, the entire contents of which are incorporated herein by reference in their entirety.

BACKGROUND

1. Field

An aspect of embodiments of the present invention relates to an organic light emitting display and a driving method thereof.

2. Description of the Related Art

With the development of information technologies, the importance of a display that is a connection medium for transmitting information is increased. Accordingly, flat panel displays (FPDs) such as a liquid crystal display (LCD), an organic light emitting display (OLED) and a plasma display panel (PDP) are increasingly used.

Among these FPDs, the OLED displays images using organic light emitting diodes that emit light through recombination of electrons and holes. The organic light emitting display has a fast response speed, and is driven with low power consumption.

SUMMARY

Embodiments of the present invention provide an organic light emitting display and a driving method thereof, which can improve display quality.

According to an aspect of embodiments of the present invention, there is provided an organic light emitting display including pixels at areas defined by scan lines and data lines, a scan driver configured to supply a scan signal to a specific scan line of the scan lines during a third period of the sensing frame, and configured to sequentially supply scan signals to the scan lines during a sixth period of the sensing frame, a data driver configured to supply, to the data lines, a previous data signal corresponding to a gray scale according to the scan signal supplied to the specific scan line during the third period, and configured to supply a current data signal to the data lines to be synchronized with the scan signals supplied to the scan lines during the sixth period, and a compensation unit configured to extract the threshold voltage and mobility information of the driving transistor from ones of the pixels at a specific horizontal line and coupled to the specific scan line before the scan signal is supplied to the specific scan line during the third period.

The previous data signal may include a data signal in a previous frame, and the current data signal may include a data signal in a current frame.

The data driver may be configured to supply a specific data signal to ones of the pixels at the specific horizontal line so that the threshold voltage and mobility information of the driving transistors of the ones of the pixels is extracted during the sixth period of the sensing frame.

The ones of the pixels at the specific horizontal line may receive the specific data signal during a sixth period in a previous sensing frame.

The organic light emitting display may further include a control driver configured to supply a first control signal to first control lines during a first period of the sensing frame, configured to supply the first control signal to a specific first control line during a fourth period of the sensing frame, configured to supply a second control signal to a second control line commonly coupled to the pixels during second and fifth periods of the sensing frame, and configured to supply a third control signal to a specific third control line among third control lines during the third period of the sensing frame, and the scan driver may be configured to supply a first emission control signal to a first emission control line commonly coupled to the pixels during the first and fifth periods of the sensing frame, and is configured to supply a second emission control signal to a second emission control line commonly coupled to the pixels during the first, second, fourth, and fifth periods of the sensing frame.

The specific third control line and the specific first control line may be coupled to the ones of the pixels at the specific horizontal line.

The third control signal may be supplied to the specific third control line is supplied before the scan signal is supplied to the specific scan line.

Ones of the pixels at an i-th (i is a natural number) horizontal line may each include an organic light emitting diode, a first driver configured to store the current data signal, and configured to supply the previous data signal, a second driver configured to control current supplied to the organic light emitting diode according to the previous data signal, and a third driver configured to electrically couple a corresponding data line to the second driver when the threshold voltage and mobility information of the driving transistor is extracted.

The first driver may include a second transistor coupled between the corresponding data line and a third node, and configured to be turned on when a scan signal is supplied to an i-th scan line, a third transistor coupled between the third node and a second node that is coupled to the first and second drivers, and configured to be turned on when the second control signal is supplied, and a second capacitor coupled between the third node and an initialization power source.

The second driver may include the driving transistor having a first electrode coupled to the second node, and a gate electrode coupled to a first node, a fifth transistor coupled between a second electrode of the driving transistor and the first node, and configured to be turned on when the second control signal is supplied, a sixth transistor coupled between the first node and the initialization power source, and configured to be turned on when the first control signal is supplied to an i-th first control line, a seventh transistor coupled between the second node and a first power source, and configured to be turned on when the first control signal is supplied to the i-th first control line, an eighth transistor coupled between the second node and the first power source, and configured to be turned off when the second emission control signal is supplied, and configured to be turned on otherwise, and a ninth transistor coupled between the second electrode of the driving transistor and an anode electrode of the organic light emitting diode, and configured to be turned off when the first emission control signal is supplied, and configured to be turned on otherwise.

The initialization power source may be set to a voltage that is lower than that of the data signal.

The second driver may further include a tenth transistor coupled between the anode electrode of the organic light emitting diode and the initialization power source, and may be configured to be turned on when the first control signal is supplied to the i-th first control line.

The third driver may include a fourth transistor coupled between the corresponding data line and a fourth node between the driving transistor and the organic light emitting diode, and may be configured to be turned on when the third control signal is supplied to an i-th third control line.

According to an aspect of another embodiment of the present invention, there is provided a method of driving an organic light emitting display, the method including supplying a voltage of a specific data signal to specific pixels at a specific horizontal line, and storing the voltage of the specific data signal in a first driver of the specific pixels, supplying the voltage of the specific data signal to second drivers including the driving transistors of the specific pixels, extracting threshold voltage and mobility information of the driving transistors, using current flowing from the driving transistors according to the specific data signal, storing a data signal corresponding to a gray scale in the first driver, supplying the stored data signal to the second driver, and supplying current corresponding to the data signal to an organic light emitting diode.

The specific pixels may be set in a non-emission state when current is not supplied to the organic light emitting diode.

BRIEF DESCRIPTION OF THE DRAWINGS

Example embodiments of the present invention will now be described more fully hereinafter with reference to the accompanying drawings. However, the example embodiments may be embodied in different forms, and should not be construed as strictly limited to the descriptions set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
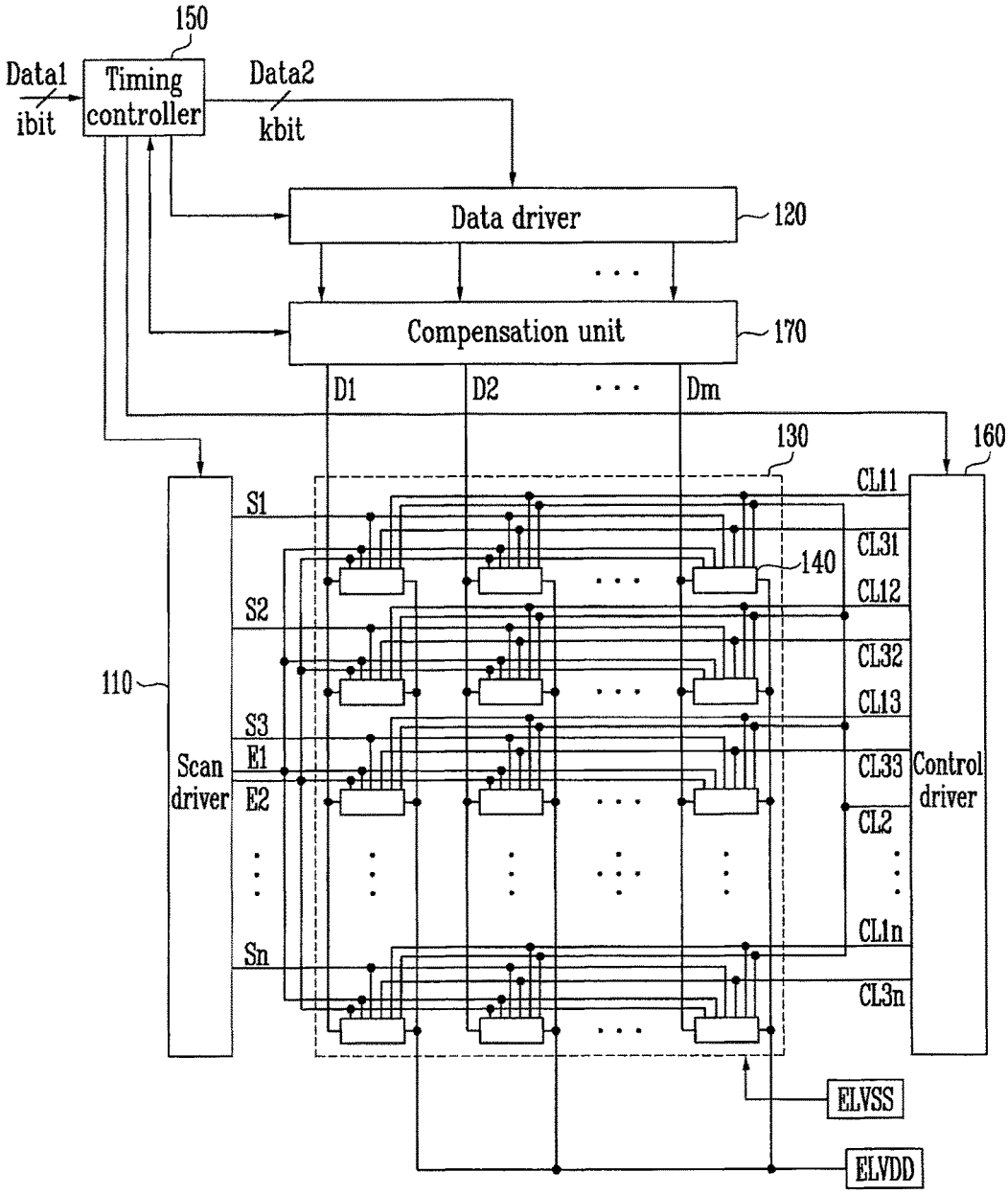
FIG. 1 is a diagram illustrating an organic light emitting display according to an embodiment of the present invention.

Hereinafter, certain exemplary embodiments according to the present invention will be described with reference to the accompanying drawings. Here, when a first element is described as being coupled to a second element, the first element may be directly coupled to the second element, or may be indirectly coupled to the second element via one or more other elements. Further, some of the elements that are not essential to the complete understanding of the invention are omitted for clarity. Also, like reference numerals refer to like elements throughout.

FIG. 1 is a diagram illustrating an organic light emitting display according to an embodiment of the present invention. Referring to FIG. 1, the organic light emitting display according to the present embodiment includes a display unit 130 including pixels 140 respectively positioned in areas defined by scan lines S1 to Sn and data lines D1 to Dm, a scan driver 110 configured to driver the scan lines S1 to Sn, a first emission control line E1, and a second emission control line E2, and a control driver 160 configured to drive first control lines CL11 to CL1*n*, a second control line CL2, and third control lines CL31 to CL3*n*.

The organic light emitting display according to the present embodiment further includes a data driver 120 configured to supply a data signal to the data lines D1 to Dm, a compensation unit 170 configured to extract threshold voltage information of a driving transistor from each pixel 140, and/or configured to extract degradation information of an organic light emitting diode from each pixel 140, and a timing controller 150 controls the drivers 110, 120 and 160 and the compensation unit 170.

Figure 3:
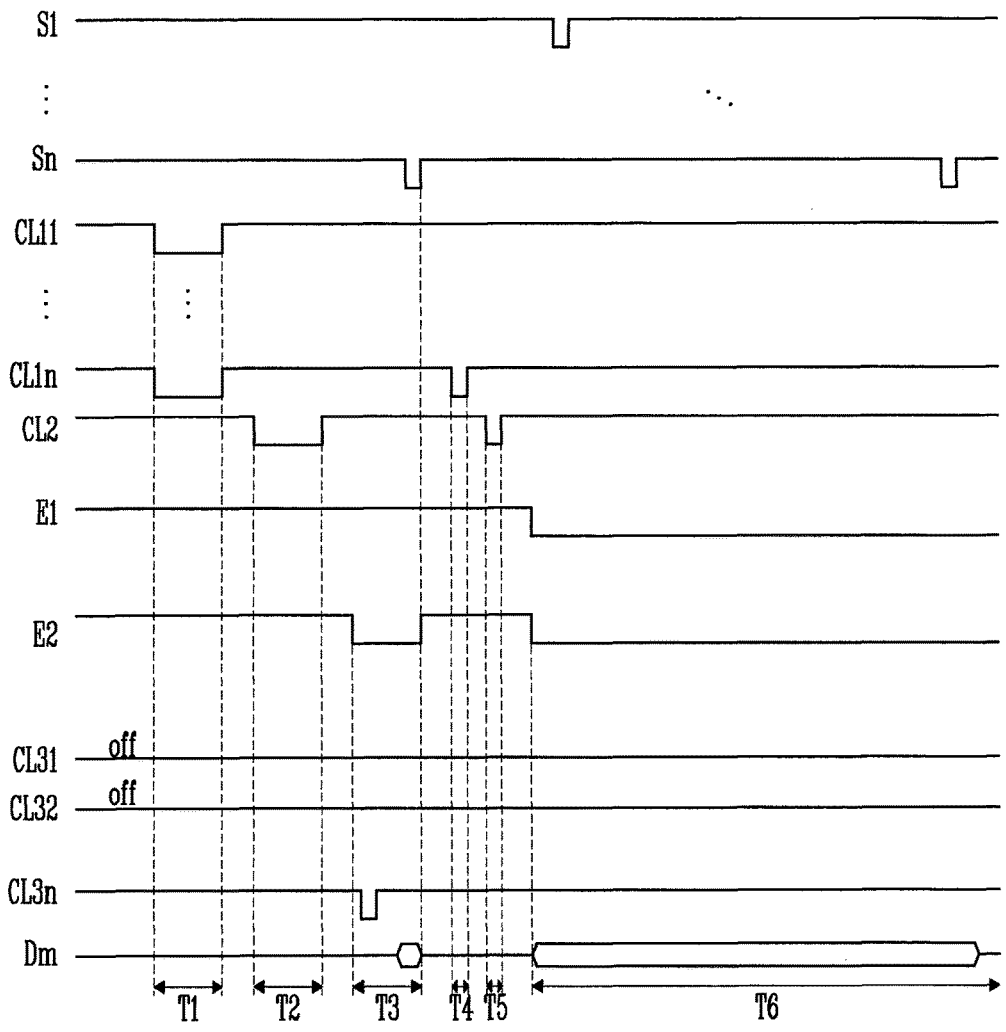
FIG. 3 is a waveform diagram illustrating a driving method according to an embodiment of the present invention.

The scan driver 110 supplies a scan signal to the scan lines S1 to Sn. For example, the scan driver 110, as shown in FIG. 3, sequentially supplies the scan signal to the scan lines S1 to Sn during a sixth period T6 in one frame 1F. Here, the sixth period T6 means a period in which the pixels 140 emit light (e.g., substantially simultaneously emit light). The scan driver 110 supplies the scan signal to a specific scan line among the scan lines S1 to Sn during a third period T3 in the one frame 1F. Here, the specific scan line is set differently every frame. For example, the specific scan line that is supplied the scan signal during the third period T3 may be sequentially set from a first scan line S1 to an n-th scan line Sn in subsequent frames.

The scan driver 110 supplies a first emission signal to the first emission control line E1 commonly coupled to the pixels 140, and supplies a second emission control signal to the second emission control line E2 commonly coupled to the pixels 140. For example, the scan driver 110 may supply the first emission control signal to the first emission control line E1 during first to fifth periods T1 to T5 in the one frame 1F. The scan driver 110 may supply the second emission control signal to the second emission control line E2 during the first, second, fourth and fifth periods T1, T2, T4 and T5 in the one frame 1F. Here, the scan signal supplied from the scan driver 110 is set to a voltage (e.g., a low voltage) at which transistors included in the pixels 140 are turned on, and the first and second emission control signals are set to a voltage (e.g., a high voltage) at which the transistors are turned off.

The control driver 160 supplies a second control signal to the second control line CL2 commonly coupled to the pixels 140. For example, the control driver 160 may supply the second control signal to the second control line CL2 during the second and fifth periods T2 and T5 in the one frame 1F.

The control driver 160 supplies a first control signal to the first control lines CL11 to CL1*n* formed at every horizontal line. Here, the control driver 160 supplies (e.g., simultaneously supplies) the first control signal to each of the first control lines CL11 to CL1*n* during the first period T1 in the one frame 1F. The control driver 160 supplies the first control signal to a specific first control line (any one of CL11 to CL1*n*) during the fourth period T4 in the one frame 1F (e.g., to CL1*n* in FIG. 3). Here, the specific first control line is set differently every frame. For example, the specific first control line may be sequentially set from a first control line CL11 to an n-th first control line CL1*n* in subsequent frames. Additionally, the specific first control line that is supplied with the first control signal during the fourth period T4 (e.g., CL1*n* in FIG. 3) is positioned on the same horizontal line as the specific scan line that is supplied the scan signal during the third period T3 (e.g., Sn in FIG. 3). In the present embodiment, the specific scan line receiving the scan signal during the third period T3 and the specific first control line receiving the first control signal during the fourth period T4 in the same frame are coupled to the same pixels in a common horizontal line.

The control driver 160 supplies a third control signal to the third control lines CL31 to CL3*n* formed at every row/horizontal line. For example, the control driver 160 supplies the third control signal to a specific third control line (any one of CL31 to CL3*n*) during the third period T3 in the one frame 1F. In the present embodiment, the specific third control line is set differently every frame. For example, the specific third control line may be sequentially set from a first third control line CL31 to an n-th third control line CL3*n* in respective subsequent frames. Additionally, the specific third control line (e.g., CL3*n* in FIG. 3) is positioned on the same horizontal line as the specific scan line (e.g., Sn in FIG. 3), to be coupled to the same pixels. The first, second, and third control signals supplied from the control driver 160 are set to a voltage (e.g., a low voltage) at which the corresponding transistors included in the pixels 140 are turned on.

The data driver 120 supplies a current data signal to the data lines D1 to Dm to be synchronized with the scan signal supplied to the scan lines S1 to Sn during the sixth period T6 in the one frame 1F. The data driver 120 supplies a previous data signal to the data lines D1 to Dm, the previous data signal corresponding to the scan signal supplied to the specific scan line during the third period T3. Here, the current data signal means a data signal in a current frame, and the previous data signal means a data signal in a previous frame.

Meanwhile, a specific data signal may be included in the current data signal supplied during the sixth period T6 so that the threshold voltage information of the driving transistor can be extracted. For example, the data driver 120 may supply (to the data lines D1 to Dm) a specific data signal corresponding to one horizontal line during the sixth period T6. When a specific data signal is supplied to a j-th (j is a natural number) row/horizontal line during the current frame, a j-th first control line CL1*j*, is driven during the fourth period T4 in the subsequent/next frame, and a j-th third control line CL3*j* and a j-th scan line Sj are driven during the third period T3 in the subsequent/next frame.

The compensation unit 170 extracts degradation information and/or threshold voltage information from each pixel 140. To this end, the compensation unit 170 is coupled to the pixels 140 via the data lines D1 to Dm. In a case where the specific data signal is supplied to the j-th horizontal line, the compensation unit 170 may extract threshold voltage information of the driving transistor from each pixel 140 positioned on the j-th horizontal line, corresponding to the third control signal supplied to the j-th third control line CL3*j*. The threshold voltage information extracted by the compensation unit 170 is supplied to the timing controller 150. Additionally, the compensation unit 170, during a separate sensing period, may extract degradation information of the organic light emitting diode included in each pixel 140, and may supply the extracted degradation information to the timing controller 150. The process of extracting the degradation information of the organic light emitting diode may be implemented by various methods currently known in the art, and therefore, its detailed description will be omitted.

Meanwhile, the compensation unit 170 may be formed into various structures so that the degradation information and/or the threshold voltage information can be extracted. For example, in the present embodiment, the compensation unit 170 may be selected as any one of various compensation units currently known in the art, so that the degradation information and/or the threshold voltage information can be extracted.

The timing controller 150 controls the scan driver 110, the data driver 120, the control driver 160, and the compensation unit 170. The timing controller 150 generates a second data Data2 (see FIG. 1) by changing a bit value of an externally input first data Data1, so that the degradation and/or the threshold voltage can be compensated corresponding to the degradation information and/or the threshold voltage information, which are supplied from the compensation unit 170. Here, the first data Data1 is set to i (i is a natural number) bits, and the second data Data2 is set to k (k is a natural number) bits.

The display unit 130 includes the pixels 140 positioned in the areas defined by the scan lines S1 to Sn and the data lines D1 to Dm. Each pixel 140, during the sixth period T6, charges the data signal of the current frame (the current data signal), and simultaneously emits light corresponding to the data signal of the previous frame (the previous data signal).

Meanwhile, although it has been illustrated that the first emission control lines E1 to E2 are coupled to the scan driver 110, and that the control lines CL11 to CL1*n*, CL2, and CL31 to CL3*n* are coupled to the control driver 160, the present invention is not limited thereto. For example, in other embodiments of the present invention, the control lines CL11 to CL1*n*, CL2, and CL31 to CL3*n* may receive a control signal supplied from the scan driver 110.

Figure 2:
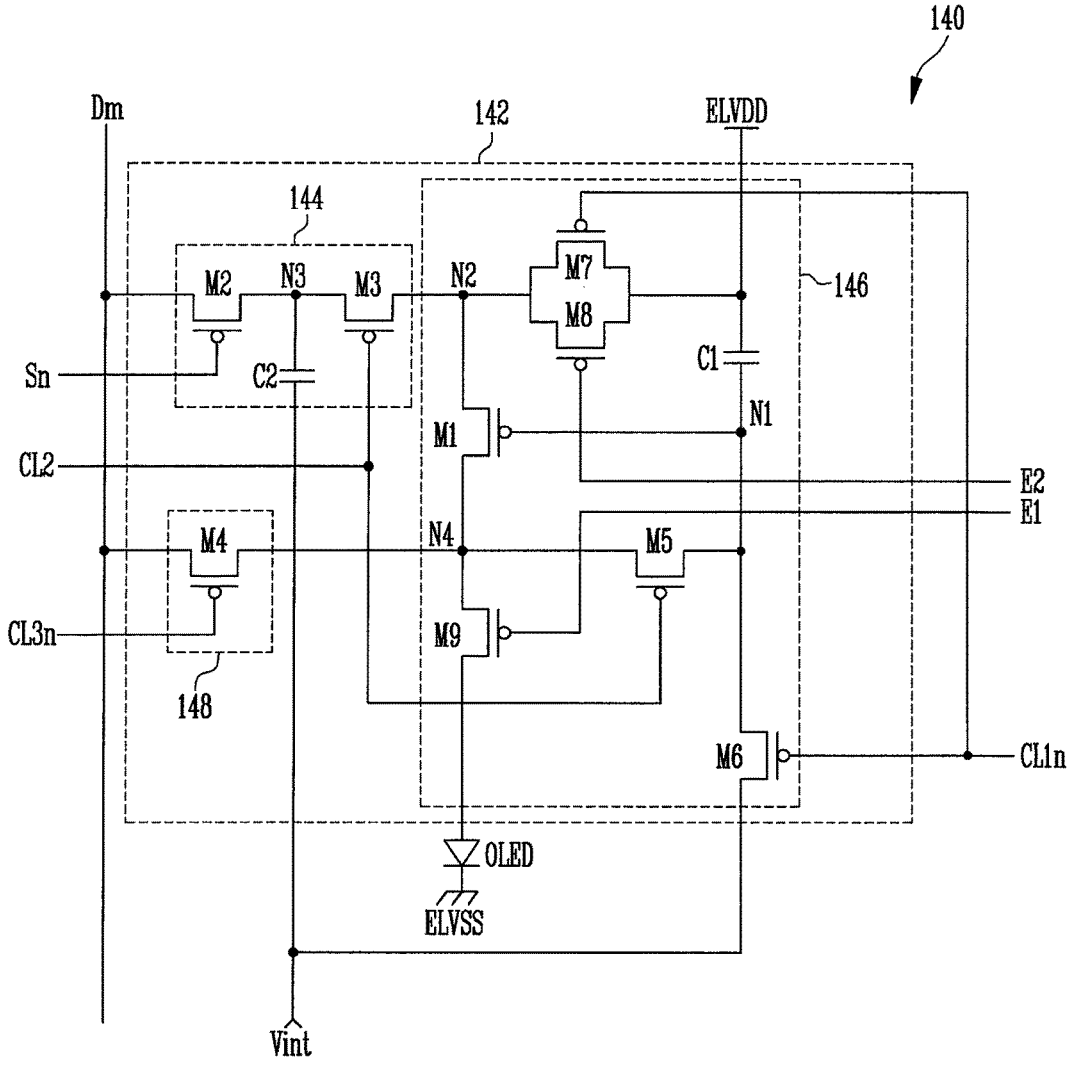
FIG. 2 is a circuit diagram illustrating a pixel according to an embodiment of the present invention.

FIG. 2 is a circuit diagram illustrating a pixel according to an embodiment of the present invention. For convenience of illustration, a pixel coupled to an m-th data line Dm and to an n-th scan line Sn will be shown in FIG. 2.

Referring to FIG. 2, the pixel 140 according to the present embodiment includes an organic light emitting diode OLED, and a pixel circuit 142 configured to control the amount of current supplied to the organic light emitting diode OLED.

An anode electrode of the organic light emitting diode OLED is coupled to the pixel circuit 142, and a cathode electrode of the organic light emitting diode OLED is coupled to a second power source ELVSS. The organic light emitting diode OLED emits light (e.g., light with a predetermined luminance) corresponding to the amount of current supplied from the pixel circuit 142. The second power source ELVSS is set to a voltage lower than that of a first power source ELVDD, so that current can flow through the organic light emitting diode OLED.

The pixel circuit 142 includes a first driver 144 configured to store the current data signal, a second driver 146 configured to control the amount of the current supplied to the organic light emitting diode OLED according to the previous data signal, and a third driver 148 configured to control the coupling between the second driver 146 and the data line Dm.

The first driver 144 stores the current data signal supplied from the data line Dm, and simultaneously supplies the previous data signal to the second driver 146. Additionally, when the previous data signal is a specific data signal for extracting the threshold voltage of a driving transistor, the second driver 146 passes through a process of receiving the previous data signal corresponding to a gray scale. This will be described in detail later. The first driver 144 includes a second transistor M2, a third transistor M3 and a second capacitor C2.

A first electrode of the second transistor M2 is coupled to the data line Dm, and a second electrode of the second transistor M2 is coupled to a third node N3. A gate electrode of the second transistor M2 is coupled to the scan line Sn. The second transistor M2 is turned on when a scan signal is supplied to the scan line Sn to supply the data signal from the data line Dm to the third node N3.

A first electrode of the third transistor M3 is coupled to the third node N3, and a second electrode of the third transistor M3 is coupled to the second driver 146 (i.e., coupled to a second node N2). A gate electrode of the third transistor M3 is coupled to a second control line CL2. The third transistor M3 is turned on when a second control signal is supplied to the second control line CL2 to allow the third and second nodes N3 and N2 to be electrically coupled to each other.

The second capacitor C2 is coupled between the third node N3 and a fixed voltage source (e.g., an initialization power source Vint). The second capacitor C2 charges a voltage corresponding to the current data signal during a period in which the second transistor M2 is turned on.

The second driver 146 charges a voltage corresponding to the previous data signal supplied from the first driver 144, and controls the amount of current flowing from the first power source ELVDD to the second power source ELVSS via the organic light emitting diode OLED, the amount of current corresponding to the charged voltage. To this end, the second driver 146 includes a first transistor M1, fifth to ninth transistors M5 to M9, and a first capacitor C1.

A first electrode of the first transistor M1 (i.e., the driving transistor) is coupled to the second node N2, and a second electrode of the first transistor M1 is coupled to a fourth node N4. A gate electrode of the first transistor M1 is coupled to a first node N1. The first transistor M1 controls the amount of the current supplied to the organic light emitting diode OLED, the current corresponding to a voltage applied to the first node N1.

A first electrode of the fifth transistor M5 is coupled to the fourth node N4, and a second electrode of the fifth transistor M5 is coupled to the first node N1. A gate electrode of the fifth transistor M5 is coupled to the second control line CL2. The fifth transistor M5 is turned on when the second control signal is supplied to the second control line CL2 to allow the first and fourth nodes N1 and N4 to be electrically coupled to each other. When the first and fourth nodes N1 and N4 are electrically coupled to each other, the first transistor M1 is diode-coupled.

A first electrode of the sixth transistor M6 is coupled to the first node N1, and a second electrode of the sixth transistor M6 is coupled to the fixed power source/initialization power source Vint. A gate electrode of the sixth transistor M6 is coupled to a first control line CL1*n*. The sixth transistor M6 is turned on when a first control signal is supplied to the first control line CL1*n* to supply the voltage of the initialization power source Vint to the first node N1.

A first electrode of the seventh transistor M7 is coupled to the first power source ELVDD, and a second electrode of the seventh transistor M7 is coupled to the second node N2. A gate electrode of the seventh transistor M7 is coupled to the first control line CL1*n*. The seventh transistor M7 is turned on when the first control signal is supplied to the first control line CL1*n* to supply the voltage of the first power source ELVDD to the second node N2.

A first electrode of the eighth transistor M8 is coupled to the first power source ELVDD, and a second electrode of the eighth transistor M8 is coupled to the second node N2. A gate electrode of the eighth transistor M8 is coupled to a second emission control line E2. The eighth transistor M8 is turned off when the second emission control signal is supplied (e.g., supplied at a high voltage) to the second emission control line E2, and is turned on when the second emission control signal is not supplied.

A first electrode of the ninth transistor M9 is coupled to the fourth node N4, and a second electrode of the ninth transistor M9 is coupled to the anode electrode of the organic light emitting diode OLED. A gate electrode of the ninth transistor M9 is coupled to a first emission control line E1. The ninth transistor M9 is turned off when a first emission control signal is supplied to the first emission control line E1, and is turned on when the first emission control signal is not supplied.

The first capacitor C1 is coupled between the first power source ELVDD and the first node N1. The first capacitor C1 charges a voltage corresponding to the data signal and the threshold voltage of the first transistor M1.

The third driver 148 allows the data line Dm and the fourth node N4 of the second driver 146 to be selectively coupled to each other. The third driver 148 couples the data line Dm to the fourth node N4 during a period in which the threshold voltage information of the driving transistor, or the degradation information of the organic light emitting diode OLED, is extracted. The third driver 148 includes a fourth transistor M4 coupled between the data line Dm and the fourth node N4.

A gate electrode of the fourth transistor M4 is coupled to a third control line CL3*n*. The fourth transistor M4 is turned on when a third control signal is supplied to the third control line CL3*n* to allow the data line Dm and the fourth node N4 to be electrically coupled to each other.

FIG. 3 is a waveform diagram illustrating a driving method according to an embodiment of the present invention. In FIG. 3, it is assumed that a specific data signal is stored in pixels positioned on an n-th horizontal line during a sixth period T6 in a previous sensing frame, so that the threshold voltage information of the driving transistor can be extracted.

Referring to FIG. 3, one frame according to the present embodiment is divided into first to sixth periods T1 to T6.

The first emission control signal is supplied during the first to fifth periods T1 to T5 so that the ninth transistor M9 is set in the turn-off state. When the ninth transistor M9 is turned off, the second driver 146 and the organic light emitting diode OLED are electrically decoupled from each other, and accordingly, the organic light emitting diode OLED is set in the non-emission state during the first to fifth periods T1 to T5. The second emission control signal is supplied during the first, second, fourth and fifth periods T1, T2, T4, and T5 so that the eighth transistor M8 is set in the turn-off state.

The first control signal is supplied to the first control lines CL11 to CL1*n* during the first period T1. When the first control signal is supplied to the first control lines CL11 to CL1*n*, the sixth and seventh transistors M6 and M7 are turned on.

When the sixth transistor M6 is turned on, the voltage of the initialization power source Vint is supplied to the first node N1. When the seventh transistor M7 is turned on, the voltage of the first power source ELVDD is supplied to the second node N2. Here, the initialization power source Vint is set to a voltage that is lower than that of the data signal (i.e., a voltage lower than that of the first power source ELVDD). Hence, the first transistor M1 is set in an on-bias state during the first period T1. When the first transistor M1 is initialized to the on-bias state, an image of a desired luminance can be displayed regardless of the data signal supplied in the previous period.

The second control signal is supplied to the second control line CL2 during the second period T2. When the second control signal is supplied to the second control line CL2, the third and fifth transistors M3 and M5 are turned on. When the fifth transistor M5 is turned on, the first and fourth nodes N1 and N4 are electrically coupled to each other, and accordingly, the first transistor M1 is diode-coupled. When the third transistor M3 is turned on, the voltage of the previous data signal, which is stored in the second capacitor C2, is supplied to the second node N2. In this case, the voltage of the first node N1 is initialized to the voltage of the initialization power source Vint, which is lower than the voltage of the data signal, and hence, the first transistor M1 is turned on.

When the first transistor M1 is turned on, the voltage applied to the second node N2 is supplied to the first node N1 via the diode-coupled first transistor M1. In this case, the first capacitor C1 stores a voltage corresponding to the data signal and the threshold voltage of the first transistor M1. Meanwhile, a voltage corresponding to the specific data signal stored in the second capacitor C2 during the previous frame is stored in the first capacitor C1 of each pixel 140 positioned on an n-th horizontal line during the second period T2.

The supply of the second emission control signal to the second emission control line E2 is stopped during the third period T3, and accordingly, the eighth transistor M8 is turned on. When the eighth transistor M8 is turned on, the voltage of the first power source ELVDD is supplied to the second node N2. In this case, the ninth transistor M9 is set in the turn-off state, and hence, the pixels 140 are set in the non-emission state.

During the third period T3, the third control signal is supplied to the n-th third control line CL3*n*, and the scan signal is supplied to the n-th scan line Sn. When the third control signal is supplied to the n-th third control line CL3*n*, the fourth transistor M4 of each pixel positioned on the n-th horizontal line is turned on.

When the fourth transistor M4 is turned on, each pixel 140 positioned on the n-th horizontal line is coupled to a corresponding one of the data lines D1 to Dm, corresponding to the installation position thereof (e.g., depending on the column/vertical line in which the pixel 140 is positioned). In this case, the first transistor M1 of each pixel 140 positioned on the n-th horizontal line supplies current (e.g., a predetermined current) to the data lines D1 to Dm according to the specific data signal stored in the first capacitor C1. Then, the compensation unit 170 extracts threshold voltage information and mobility information of the first transistors M1 of the pixels 140 positioned on the n-th horizontal line according to the current supplied from the data lines D1 to Dm, and then provides the extracted information to the timing controller 150.

Subsequently, the scan signal is supplied to the n-th scan line Sn, and accordingly, the second transistors M2 of the pixels 140 positioned on the n-th horizontal line are turned on. When the second transistors M2 are turned on, the third node N3 of each pixel 140 is coupled to the corresponding one of the data lines D1 to Dm according to the position/column location of the pixel 140. In this case, the data driver 120 supplies (to the data lines D1 to Dm) a previous data signal corresponding to a gray scale to be expressed, and accordingly, the previous data signal corresponding to the gray scale is stored in the second capacitor C2.

The first control signal is supplied to the n-th first control line CL1*n* during the fourth period T4. When the first control signal is supplied to the n-th first control line CL1*n*, the sixth and seventh transistors M6 and M7 are turned on, and accordingly, the first transistors M1 of the pixels 140 positioned on the n-th horizontal line are initialized to the on-bias state.

The second control signal CL2 is supplied to the second control line CL2 during the fifth period T5, and accordingly, the third and fifth transistors M3 and M5 are turned on. Then, the first capacitor C1 of each pixel 140 positioned on the n-th horizontal line charges a voltage (e.g., a predetermined voltage) according to the previous data signal stored in the second capacitor C2. The second capacitor C2 of each pixel 140 positioned on the first and (n−1)-th horizontal lines additionally charges a voltage (e.g., a predetermined voltage) according to the voltage of the previous data signal stored in the first capacitor C1.

During the sixth period T6, the supply of the first emission control signal to the first emission control line E1 and the supply of the second emission control signal to the second emission control line E2 are stopped. When the supply of the first emission control signal to the first emission control line E1 is stopped, the ninth transistor M9 is turned on. When the ninth transistor M9 is turned on, the fourth node N4 and the anode electrode of the organic light emitting diode OLED are electrically coupled to each other. When the supply of the second emission control signal to the second emission control line E2 is stopped, the eighth transistor M8 is turned on. When the eighth transistor M8 is turned on, the voltage of the first power source ELVDD is supplied to the second node N2.

Then, the first transistor M1 controls the amount of the current flowing from the first power source ELVDD to the second power source ELVSS via the organic light emitting diode OLED according to the voltage applied to the first node N1. In this case, the organic light emitting diode OLED generates light (e.g., light with a predetermined luminance) according to the amount of current supplied thereto.

Meanwhile, the scan signal is sequentially supplied to the scan lines S1 to Sn during the sixth period T6. When the scan signal is sequentially supplied to the scan lines S1 to Sn, the second transistors M2 included in the pixels 140 positioned on each horizontal line are sequentially turned on (e.g., row by row). When the second transistor M2 is turned on, the current data signal from a corresponding data line among the data lines D1 to Dm is supplied to the third node N3 included in each pixel 140. In this case, the second capacitor C2 charges a voltage corresponding to the current data signal. In the present embodiment, an image (e.g., a predetermined image) is implemented by repeating the process described above. Additionally, a specific data signal may be supplied to pixels positioned at one horizontal line (e.g., the first horizontal line) during the sixth period T6.

As described above, in the present embodiment, it is possible to extract the threshold voltage and mobility information of the driving transistor M1 included in each pixel 140 positioned on each horizontal line. Particularly, in the present embodiment, a data signal corresponding to a gray scale is additionally supplied to the corresponding pixel after the threshold voltage and mobility information of the driving transistor M1 is extracted, making it possible to display an image corresponding to a desired gray scale during the emission period T6.

Meanwhile, the sensing frame in which the threshold voltage and mobility information of the driving transistor M1 is extracted may be included when necessary. For example, a plurality of sensing frames may be included after a power source is initially input to the organic light emitting display. The third to fifth periods T3 to T5 are deleted in frames that exclude the sensing frame. When the third to fifth periods T3 to T5 are deleted, an image is implemented without extracting the threshold and mobility information of the driving transistor.

Figure 4:
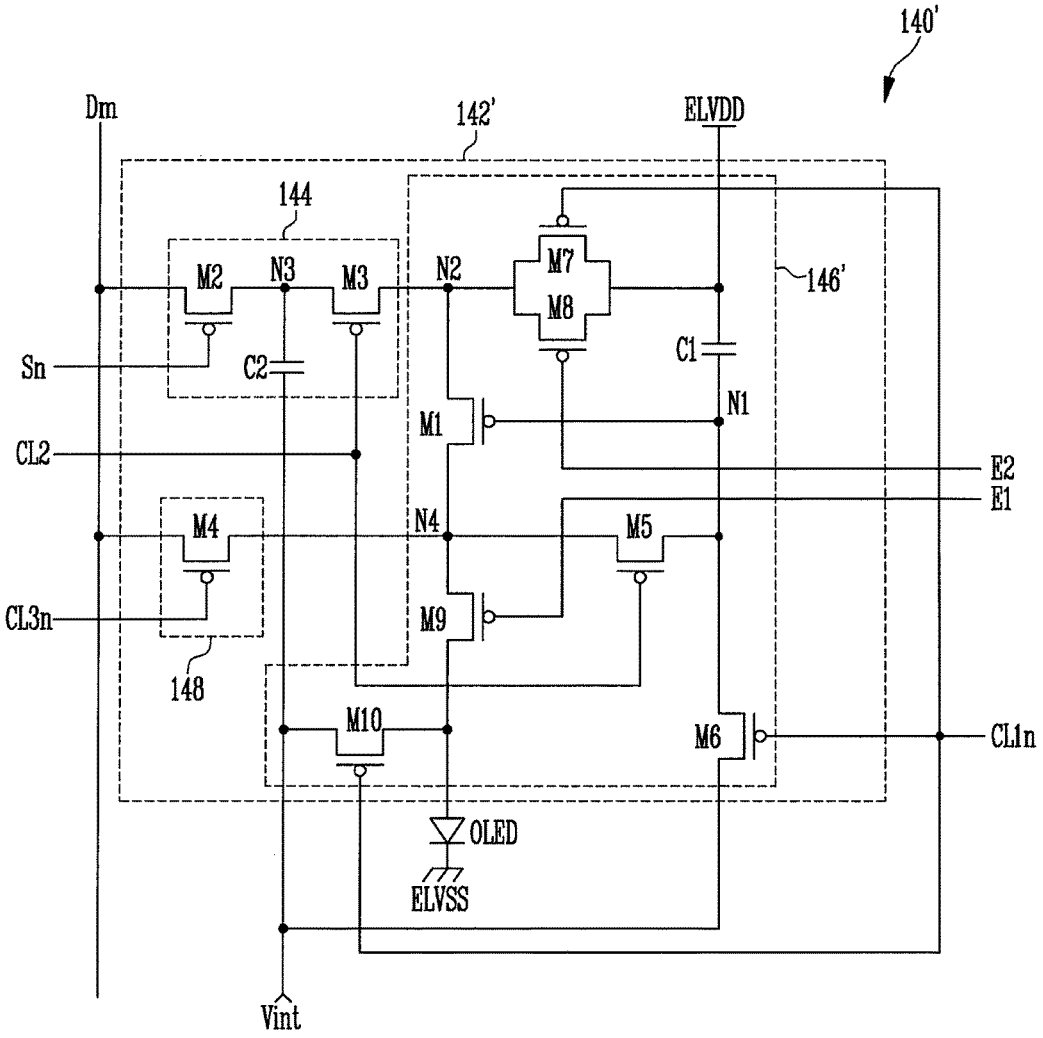
FIG. 4 is a circuit diagram illustrating a pixel according to another embodiment of the present invention.

FIG. 4 is a circuit diagram illustrating a pixel according to another embodiment of the present invention. In FIG. 4, components identical to those of FIG. 2 are designated by like reference numerals, and their detailed descriptions will be omitted.

Referring to FIG. 4, the pixel 140' according to the shown embodiment includes the organic light emitting diode OLED, and a pixel circuit 142' configured to control the amount of current supplied to the organic light emitting diode OLED.

The pixel circuit 142' includes the first driver 144 configured to store the current data, a second driver 146' configured to control the amount of the current supplied to the organic light emitting diode OLED according to the previous data signal, and the third driver 148 configured to control the coupling between the second driver 146' and the data line Dm.

The second driver 146' charges a voltage corresponding to the previous data signal supplied from the first driver 144, and controls the amount of current flowing from the first power source ELVDD to the second power source ELVSS via the organic light emitting diode OLED. The second driver 146' includes the first transistor M1, fifth to tenth transistors M5 to M10, and the first capacitor C1.

A first electrode of the tenth transistor M10 is coupled to the anode electrode of the organic light emitting diode OLED, and a second electrode of the tenth transistor M10 is coupled to the initialization power source Vint. A gate electrode of the tenth transistor M10 is coupled to the first control line CL1*n*. The tenth transistor M10 is turned on when the first control signal is supplied to the first control line CL1*n* to supply voltage of the initialization power source Vint to the anode electrode of the organic light emitting diode OLED. When the voltage of the initialization power source Vint is supplied to the anode electrode of the organic light emitting diode OLED, the voltage charged in a capacitor (not shown) equivalently formed with the organic light emitting diode OLED is discharged, and accordingly, black can be stably expressed.

Meanwhile, although it has been described in the present embodiments that the transistors are shown as PMOS transistors for convenience of illustration, the present invention is not limited thereto. In other words, the transistors may be formed as NMOS transistors.

In embodiments of the present invention, the organic light emitting diode OLED may generate red, green and blue light according to the amount of current supplied from the driving transistor, or may generate white light according to the amount of the current supplied from the driving transistor. When the organic light emitting diode OLED generates white light, a color image is implemented using a separate color filter or the like.

By way of summation and review, an organic light emitting display includes pixels respectively positioned at crossing regions of data lines, scan lines, and power lines. Each pixel generates light (e.g., light with a predetermined luminance) according to the amount of current supplied to an organic light emitting diode, which corresponds to an applied data signal. Each pixel includes a driving transistor configured to control the amount of current supplied to the organic light emitting diode according to the data signal.

Meanwhile, in the organic light emitting display, a desired luminance might not be displayed due to a threshold voltage variation of the driving transistor, degradation of the organic light emitting diode, etc. To overcome such a problem, there has been proposed a method of extracting threshold voltage information of a driving transistor and/or degradation information of an organic light emitting diode, and controlling or adjusting data using the extracted information. However, when a specific data signal is supplied to the pixels to extract the threshold voltage information of the driving transistor, an undesired image is displayed in a display panel.

In the organic light emitting display and the driving method thereof according to embodiments of the present invention, the threshold voltage of the driving transistor is extracted corresponding to a specific data signal during a period in which the pixel does not emit light. After the threshold voltage of the driving transistor is extracted, a data signal corresponding to a gray scale is supplied to the pixel, and accordingly, a desired image can be displayed in the display unit.

Example embodiments have been disclosed herein, and although specific terms are employed, they are used and are to be interpreted in a generic and descriptive sense only, and are not for the purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. An organic light emitting display configured to be driven using a plurality of sensing frames for extracting threshold voltage and mobility information of driving transistors included in pixels, the organic light emitting display comprising:

the pixels at areas defined by scan lines and data lines;

a scan driver configured to supply a scan signal to a specific scan line of the scan lines during a third period of a sensing frame of the sensing frames, and configured to sequentially supply scan signals to the scan lines during a sixth period of the sensing frame;

a data driver configured to supply, to the data lines, a previous data signal corresponding to a gray scale according to the scan signal supplied to the specific scan line during the third period, and configured to supply a current data signal to the data lines to be synchronized with the scan signals supplied to the scan lines during the sixth period; and a compensator configured to extract the threshold voltage and mobility information of the driving transistors from ones of the pixels at a specific horizontal line and coupled to the specific scan line before any signals are supplied to the specific scan line during the third period.

2. The organic light emitting display of claim 1, wherein the previous data signal comprises a data signal in a previous frame, and the current data signal comprises a data signal in a current frame.

3. The organic light emitting display of claim 1, wherein the data driver is configured to supply a specific data signal to other ones of the pixels at another specific horizontal line during the sixth period so that the threshold voltage and mobility information of the driving transistors of the other ones of the pixels is extracted during a third period of a subsequent sensing frame.

4. The organic light emitting display of claim 3, wherein the ones of the pixels at the specific horizontal line are configured to receive a specific data signal during a sixth period in a previous sensing frame.

5. An organic light emitting display configured to be driven using a plurality of sensing frames for extracting threshold voltage and mobility information of driving transistors included in pixels, the organic light emitting display comprising:

the pixels at areas defined by scan lines and data lines;

a scan driver configured to supply a scan signal to a specific scan line of the scan lines during a third period of a sensing frame of the sensing frames, and configured to sequentially supply scan signals to the scan lines during a sixth period of the sensing frame;

a data driver configured to supply, to the data lines, a previous data signal corresponding to a gray scale according to the scan signal supplied to the specific scan line during the third period, and configured to supply a current data signal to the data lines to be synchronized with the scan signals supplied to the scan lines during the sixth period;

a compensator configured to extract the threshold voltage and mobility information of the driving transistors from ones of the pixels at a specific horizontal line and coupled to the specific scan line before the scan signal is supplied to the specific scan line during the third period; and a control driver configured to supply a first control signal to first control lines during a first period of the sensing frame, configured to supply the first control signal to a specific first control line during a fourth period of the sensing frame, configured to supply a second control signal to a second control line commonly coupled to the pixels during second and fifth periods of the sensing frame, and configured to supply a third control signal to a specific third control line among third control lines during the third period of the sensing frame, wherein the scan driver is configured to supply a first emission control signal to a first emission control line commonly coupled to the pixels during the first and fifth periods of the sensing frame, and is configured to supply a second emission control signal to a second emission control line commonly coupled to the pixels during the first, second, fourth, and fifth periods of the sensing frame.

6. The organic light emitting display of claim 5, wherein the specific third control line and the specific first control line are coupled to the ones of the pixels at the specific horizontal line.

7. The organic light emitting display of claim 5, wherein the third control signal supplied to the specific third control line is supplied before the scan signal is supplied to the specific scan line.

8. The organic light emitting display of claim 5, wherein ones of the pixels at an i-th (i is a natural number) horizontal line each comprises:

an organic light emitting diode;

a first driver configured to store the current data signal, and configured to supply the previous data signal;

a second driver configured to control current supplied to the organic light emitting diode according to the previous data signal; and a third driver configured to electrically couple a corresponding data line to the second driver when the threshold voltage and mobility information of a corresponding one of the driving transistors is extracted.

9. The organic light emitting display of claim 8, wherein the first driver comprises:

a second transistor coupled between the corresponding data line and a third node, and configured to be turned on when a scan signal is supplied to an i-th scan line;

a third transistor coupled between the third node and a second node that is coupled to the first and second drivers, and configured to be turned on when the second control signal is supplied; and a second capacitor coupled between the third node and an initialization power source.

10. The organic light emitting display of claim 9, wherein the second driver comprises:

the driving transistor having a first electrode coupled to the second node, and a gate electrode coupled to a first node;

a fifth transistor coupled between a second electrode of the driving transistor and the first node, and configured to be turned on when the second control signal is supplied;

a sixth transistor coupled between the first node and the initialization power source, and configured to be turned on when the first control signal is supplied to an i-th first control line;

a seventh transistor coupled between the second node and a first power source, and configured to be turned on when the first control signal is supplied to the i-th first control line;

an eighth transistor coupled between the second node and the first power source, and configured to be turned off when the second emission control signal is supplied, and configured to be turned on otherwise; and a ninth transistor coupled between the second electrode of the driving transistor and an anode electrode of the organic light emitting diode, and configured to be turned off when the first emission control signal is supplied, and configured to be turned on otherwise.

11. The organic light emitting display of claim 10, wherein the initialization power source is set to a voltage that is lower than that of the data signal.

12. The organic light emitting display of claim 10, wherein the second driver further comprises a tenth transistor coupled between the anode electrode of the organic light emitting diode and the initialization power source, and configured to be turned on when the first control signal is supplied to the i-th first control line.

13. The organic light emitting display of claim 8, wherein the third driver comprises a fourth transistor coupled between the corresponding data line and a fourth node between the driving transistor and the organic light emitting diode, and configured to be turned on when the third control signal is supplied to an i-th third control line.

14. A method of driving an organic light emitting display using a plurality of sensing frames for extracting threshold voltage and mobility information of driving transistors of pixels, the method comprising:

supplying a voltage of a specific data signal to specific pixels at a specific horizontal line, and storing the voltage of the specific data signal in a second capacitor included in a first driver of each of the specific pixels;

supplying the voltage of the specific data signal to a first capacitor included in a second driver comprising the driving transistor of each of the specific pixels;

extracting threshold voltage and mobility information of the driving transistors, using current flowing from the driving transistors according to the specific data signal;

storing a current data signal corresponding to a gray scale in the second capacitor included in the first driver of each of the pixels concurrently with a scan signal supplied to each of the pixels;

supplying a stored previous data signal to the first capacitor included in the second driver of each of the pixels before storing the current data signal in the second capacitor included in the first driver; and supplying current corresponding to the previous data signal to an organic light emitting diode.

15. The method of claim 14, wherein the specific pixels are set in a non-emission state when current is not supplied to the organic light emitting diode.

* * * * *